United States Patent [19]

Liu

[11] 4,352,540

[45] Oct. 5, 1982

[54] ELECTRICAL PLUG

[76] Inventor: Liang-Huang Liu, 97, Lane 192, Hsui-Yuan Rd., Feng-Yuan City, Taiwan

[21] Appl. No.: 171,311

[22] Filed: Jul. 23, 1980

[51] Int. Cl.[3] ..... H01R 33/04

[52] U.S. Cl. ..... 339/196 R; 339/217 PS

[58] Field of Search ..... 339/206 R, 206 P, 210 R, 339/210 M, 184 R, 184 M, 185 R, 191 R, 195 R, 198 P, 196 R, 196 A, 196 M, 195 A, 195 M, 217 PS

[56] References Cited

U.S. PATENT DOCUMENTS

| | | | |
|---|---|---|---|
| 994,516 | 6/1911 | Hubbell | 339/196 R X |
| 2,272,432 | 2/1942 | Rogie | 339/196 R X |
| 2,918,647 | 12/1959 | Britt | 339/196 R X |
| 3,273,105 | 9/1966 | Klassen | 339/210 R X |
| 3,313,905 | 4/1967 | Zagorski | 339/196 R X |

FOREIGN PATENT DOCUMENTS

| | | | |
|---|---|---|---|
| 676043 | 7/1952 | United Kingdom | 339/196 R |

*Primary Examiner*—John McQuade
*Assistant Examiner*—John S. Brown

[57] ABSTRACT

An improved electrical plug comprises two housings, wherein the lower housing has two stop blocks formed symmetrically on the inside rim thereof, a cross-shaped division plate on its center portion, a plurality of protrusions provided on both surfaces of the stop blocks and the division plate for securing two twisted conducting prongs in their appropriate position by engaging orifices at the end surfaces of the conducting prongs with the protrusions for quick and safe connection and/or disconnection with respect to the lower housing.

6 Claims, 3 Drawing Figures

ELECTRICAL PLUG

BACKGROUND OF THE INVENTION

1. Field of the Invention

This invention relates to an improved electrical plug and more particular, to a novel electrical plug being safe in design and convenient for quick connection and disconnection in use.

2. Description of the Prior Art

Conventionally, the electrical plug as shown in FIG. 1 consists of an upper shell 10 and a lower shell 20. The lower shell 20 has an opening 11 for receiving a cord (not shown), a divider plate 16 with a screw hole 17 provided on the center part thereof, two supporting blocks 14, 15, and two prong receiving slots 12, 13 provided on the front part thereof. When assemblying the said plug, firstly, one must fasten the wire ends of the leading cord to a pair of conducting prongs 18, 19 by means of screws 31, 32, then, guiding locking slots 21, 22 of the conducting prongs 18, 19 into the slots 12, 13 with the lower portions of the prongs resting respectively on the supporting blocks 14, 15, place the upper shell 10 over the lower shell 20, put the nut 41 on one end of the screw hole 17 and insert the locking screw 40 through another end of the screw hole 17, turn the locking screw to unite said two shells. In view of the aforesaid structure and arrangement, the outstanding drawbacks of the conventional electrical plug are that when one assembles the plug, the conducting prongs must be taken apart first and then the wire ends of the leading cord can be fastened thereby to means of the screws attached thereto. As the conducting prongs are usually small metal plates, it is difficult to fix them and even more difficult to tighten the wire ends thereat so that poor electrical contact often occurs. On the other hand, owing to the conducting prongs connected to the lower shell only by means of two prong receiving slots, the conducting prongs are always in a loose condition causing the space between the two conducting prongs to change easily so that the said plug cannot be fitly inserted into the receptacle; moreover, because of the poor contact and loose condition, the shells often get too hot, become damaged, and even cause fire and short circuit.

SUMMARY OF THE INVENTION

It is an object of the present invention to provide an improved electrical plug having a lower portion of the conducting prongs thereof twisted at a right angle to the upper portion and bent by 90° at the lower end with a plurality of orifices thereof so as to engage them with the protrusions on the stop blocks and division plate not only making the contacting area wider for the convenience of fastening the wire ends of the leading cord thereat but also preventing the conducting prongs from getting loose.

Another object of the present invention is to provide reinforcing strips along the division plate and two stop blocks so as to increase the shock resistance of the lower housing.

A further object of the present invention is to provide an electrical plug having a safe and simple prong structure making the connection and disconnection of the wire ends of the leading cord be done directly on the planar surfaces of the conducting prongs by means of the attached wire screws without taking the conducting prongs apart so that the conducting prongs always remain in good and safe condition eradicating the defects of poor contacting and looseness as existing in the conventional electrical plug.

DETAILED DESCRIPTION OF THE INVENTION

Figure 2:
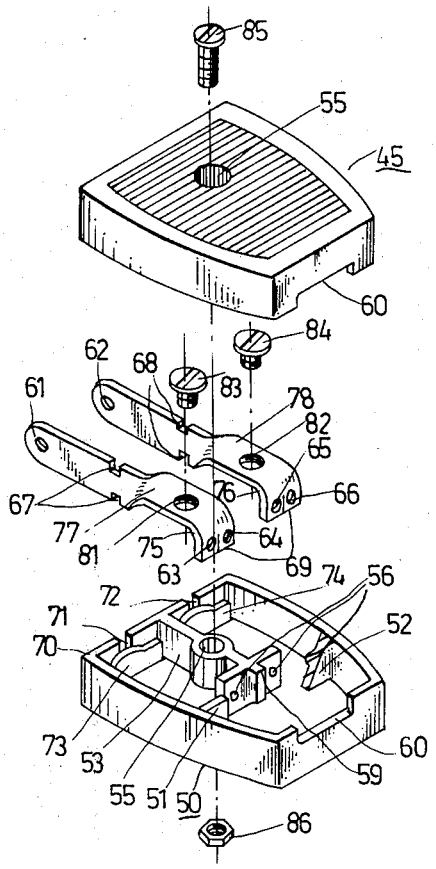
FIG. 2 is an exploded perspective view of the present invention.

Referring now to FIG. 2, the present invention, as usual, consists of an upper housing 45 and a lower housing 50. The lower housing comprises a cord receiving opening 60, two stop blocks 51, 52 formed symmetrically on and perpendicular to the inside rim thereof, a cross-shaped divider plate 53, with a screw hole 55 in the middle for separating the conducting prongs 61, 62, two supporting plates 73, 74 and two prong receiving slots 71, 72 provided on a front rim 70 for securing the conducting prongs 61, 62 in a parallel position. Both the stop blocks 51, 52 and the divider plate 53 are reinforced on the bottom and the top for increasing their shock resistance, and both the stop blocks 51, 52 and the cross members of the divider plate 53 have a plurality of protrusions 56 on one side thereof respectively.

The conducting prongs 61, 62 include securing slots 67, 68, and have portions twisted 90° to the blade or prong position, the twisted portion having planar surfaces with screw holes 81, 82 therein for securing the wire ends of an electrical cord (not shown) by means of the screws 83, 84. Additionally, each lower end of the conducting prongs are bent by 90° to form two bent portions 75, 76, which bent portions are provided with a small slit 69 in the middle thereof for increasing their elasticity. On each side of the small slits 69 orifices 63, 64, 65, 66 are provided for engaging respectively with the protrusions 56 on both sides of the stop blocks 51, 52 and the cross members of the divider plate 53 to fix the conducting prongs in a firm position.

Figure 1:
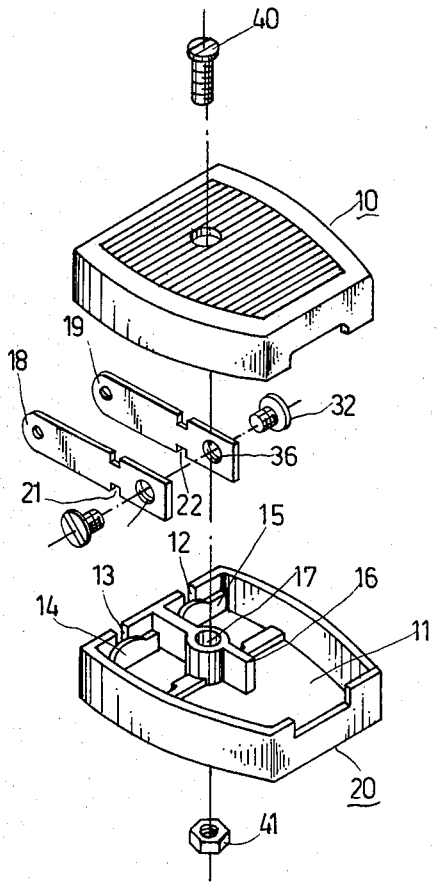
FIG.1 PRIOR ART
FIG. 1 is an exploded view of a conventional electrical plug.
Figure 3:
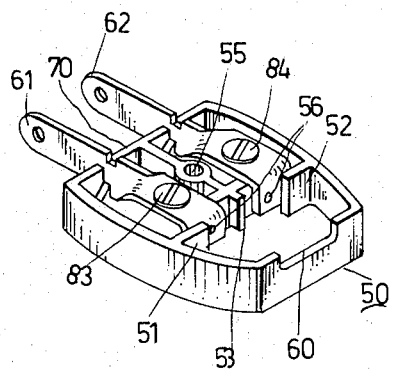
FIG. 3 is a perspective view of the present invention showing the conducting prongs assembled in the lower housing.

Referring further to FIG. 3 better showing the preferred embodiment of this invention, the contducting prongs 61, 62 are disposed in the lower housing 50 by guiding the securing slots 67, 68 of the conducting prongs 61, 62 into the prong receiving slots 71, 72 on the said front rim 70. Meanwhile, the protrusions 56 on both sides of the stop blocks 51, 52 and the cross members of the divider plate 53 are properly inserted into the orifices 63, 64, 65, 66 so that the conducting prongs 61, 62 are firmly and permanently fixed therein. The only effort required to use this improved electrical plug is to connect the wire ends of the cord to the conducting prongs 61, 62 on the planar surfaces 77, 78 by means of the screws 83, 84, cover the upper housing 45 by aligning the prong receiving slots 71, 72 at the front rim with the cord opening 60 at the rear rim, and then put a nut 86 at one end of the screw hole 55, and insert a locking screw 85 at the other end through the screw hole 55 to engage said nut 86 to unite the upper and lower housings to form an electrical plug without any indication of looseness and poor contact.

It should be apparent from the foregoing description that the present invention has completely overcome the drawbacks noted in the conventional electrical plug, and this novel, safe, simple, and practical electrical plug will greatly benefit the consumer for by its conventional and its economy. While the invention has been particularly shown and described with reference to the preferred embodiment thereof, it will be understood by those skilled in the art that various modifications may be made without departing from the spirit and scope of the invention. Therefore, it is intended that the specification and drawings be interpreted for illustration rather then for limitation, and the scope of this invention be defined in the appended claims.

I claim:

1. An improved electrical plug comprising elongated members for conveying electrical energy and a housing having first and second housing elements, at least one of said housing elements including means for fixing said elongated members in predetermined positions in said housing, and an opening in said housing permitting said elongated members to communicate between the exterior and interior of said housing, said fixing means including a wall disposed in said at least one housing element, said wall being disposed generally perpendicular to a major axis of said elongated members, and a pair of stop blocks disposed in parallel, spaced relationship to said wall in said at least one of said housing elements, the spacing between said wall and said stop blocks being sized to receive a portion of said elongated members, said wall and said stop blocks each having at least one protuberance for engaging said elongated members.

2. The plug as set forth in claim 1, further including a divider plate disposed in said at least one housing element, said divider plate being arranged generally parallel to said major axis and intersecting said wall.

3. The plug as set forth in claim 2, wherein said at least one housing element includes a rim at the outer periphery thereof and wherein said stop blocks contact said rim and engage said rim at generally a right angle.

4. The plug according to claim 3, wherein said divider plate and said stop blocks are reinforced with plastic material on both the top portion and the bottom portion to increase the shock resistance thereof.

5. The plug as claimed in claims 1, 2, 3, or 4, wherein said elongated members comprise a pair of prongs, each of said prongs defining, in a cross section taken through the major axis thereof, a rectangle, the central portion of each prong being twisted approximately 90° with respect to mating portions of said prongs, said central portions forming a planar surface and including a fastening means thereat for securing the conductor of an electrical cable thereto, the ends of said prongs remote from the mating portions thereof including an end which is formed at approximately a 90° angle to the central portion thereof, said end portion having a pair of orifices on each side of said end for engaging the protuberances on said wall and said stop blocks of said at least one of said housing elements.

6. The plug according to claim 5, wherein the ends of said elongated members include slits disposed between adjacent pairs of the orifices therein.

* * * * *